US008012071B2

(12) United States Patent
Grisdale

(10) Patent No.: US 8,012,071 B2
(45) Date of Patent: Sep. 6, 2011

(54) EXERCISE DEVICE AND METHOD

(76) Inventor: Robert Kenneth Gideon Grisdale, Toronto (CA)

( * ) Notice: Subject to any disclaimer, the term of this patent is extended or adjusted under 35 U.S.C. 154(b) by 0 days.

(21) Appl. No.: 11/824,793

(22) Filed: Jul. 3, 2007

(65) Prior Publication Data

US 2008/0009398 A1 Jan. 10, 2008

(30) Foreign Application Priority Data

Jul. 7, 2006 (CA) ..... 2551590

(51) Int. Cl.
*A63B 21/02* (2006.01)

(52) U.S. Cl. ..... 482/122; 482/125; 482/126

(58) Field of Classification Search ..... 482/121–126; 602/4; 2/311, 321, 322
See application file for complete search history.

(56) References Cited

U.S. PATENT DOCUMENTS 1,633,124 A * 6/1927 Noe ..... 482/126
1,663,641 A * 3/1928 Smallwood ..... 482/124
1,706,654 A * 3/1929 Christesen ..... 482/125
1,998,226 A * 4/1935 Draheim ..... 482/124
2,118,114 A * 5/1938 Schenk ..... 482/126
2,224,103 A * 12/1940 Nilson ..... 482/124
3,219,342 A * 11/1965 Melchiona ..... 482/49
3,307,538 A * 3/1967 Groll ..... 602/4
3,677,543 A 7/1972 Richardson
4,245,840 A * 1/1981 Van Housen ..... 482/124
4,249,686 A * 2/1981 Morwood ..... 224/150
4,515,300 A * 5/1985 Cohen ..... 224/153
4,552,356 A * 11/1985 Brousseau ..... 482/125
4,911,439 A * 3/1990 Kuhl ..... 482/124
5,207,627 A * 5/1993 Doran ..... 482/124
5,318,494 A * 6/1994 Santighian ..... 482/125
5,700,231 A * 12/1997 Wilkinson ..... 482/124
5,743,838 A * 4/1998 Willis ..... 482/124
5,860,896 A 1/1999 Mann
5,945,060 A 8/1999 Williams
6,047,406 A * 4/2000 Dicker et al. ..... 2/69
6,093,137 A 7/2000 Summers
6,110,081 A 8/2000 Barrett
6,120,422 A 9/2000 Kiemer
6,120,424 A 9/2000 Arline
6,132,346 A 10/2000 Weeks
6,224,522 B1 5/2001 Ervin
6,238,324 B1 5/2001 MacMillan
6,244,998 B1 6/2001 Hinds
6,267,711 B1 7/2001 Hinds
6,287,242 B1 9/2001 Fray
6,299,569 B1 10/2001 Rich
6,315,701 B1 11/2001 Shifferaw
6,319,180 B1 11/2001 Kallassy
6,322,483 B1 11/2001 Rotella
6,348,026 B1 2/2002 Kuo
6,368,258 B1 4/2002 Emlaw
6,390,957 B1 5/2002 Knight
6,398,694 B1 6/2002 Bountourakis
6,402,665 B1 6/2002 Edward
6,402,668 B1 6/2002 Harker
6,450,929 B1 9/2002 Markham
6,461,283 B1 10/2002 Maron (Continued)

*Primary Examiner* — Allana Lewin
(74) *Attorney, Agent, or Firm* — The Webb Law Firm

(57) ABSTRACT

An exercise device comprising a flexible band formed in a closed loop, further including at least one tension adjuster associated with the band for selectively adjusting the tension of the loop. The device further includes two handles, associated with the band, the handles being configured to facilitate gripping of the band by a user's hand.

20 Claims, 14 Drawing Sheets

U.S. PATENT DOCUMENTS

| | | | | |
|---|---|---|---|---|
| 6,482,137 | B2 | 11/2002 | Walker | |
| 6,494,817 | B2 | 12/2002 | Lake | |
| 6,517,470 | B1 | 2/2003 | Chak et al. | |
| 6,524,226 | B2 | 2/2003 | Kushner | |
| 6,540,651 | B1 | 4/2003 | Aberton et al. | |
| 6,551,221 | B1 | 4/2003 | Marco | |
| 6,558,302 | B2 | 5/2003 | Cluff | |
| 6,585,626 | B2 | 7/2003 | McBride | |
| 6,599,223 | B2 | 7/2003 | Wang et al. | |
| 6,629,912 | B2 | 10/2003 | Downs | |
| 6,634,998 | B2 | 10/2003 | Siaperas | |
| 6,652,427 | B2 | 11/2003 | Wroclawsky | |
| 6,652,431 | B1 | 11/2003 | Mattox | |
| 6,656,095 | B2 | 12/2003 | Fernandez | |
| 6,656,098 | B2 | 12/2003 | Hoffman | |
| 6,659,921 | B2 | 12/2003 | Vernon | |
| 6,662,651 | B1 | 12/2003 | Roth | |
| 6,663,546 | B2 | 12/2003 | Kallassy | |
| 6,666,801 | B1 | 12/2003 | Michalow | |
| 6,676,573 | B2 | 1/2004 | Abelbeck et al. | |
| 6,682,465 | B2 | 1/2004 | Hawthorne | |
| 6,684,410 | B2 | 2/2004 | Robinett et al. | |
| 6,685,602 | B2 | 2/2004 | Colosky, Jr. et al. | |
| 6,685,607 | B1 | 2/2004 | Olson | |
| 6,685,662 | B1 | 2/2004 | Curry et al. | |
| 6,689,024 | B2 | 2/2004 | Charnitski | |
| 6,689,030 | B1 | 2/2004 | Leslie | |
| 6,692,415 | B1 | 2/2004 | Winston | |
| 6,692,420 | B2 | 2/2004 | Walden | |
| 6,709,369 | B1 | 3/2004 | Jacobs | |
| 6,726,606 | B2 | 4/2004 | Jacobsen | |
| 6,733,428 | B2 | 5/2004 | List | |
| 2002/0160891 | A1 | 10/2002 | Gallagher | |
| 2003/0181301 | A1 | 9/2003 | Walsh | |
| 2004/0043878 | A1 | 3/2004 | Erwin | |
| 2004/0067827 | A1 | 4/2004 | Tustin | |
| 2004/0192520 | A1* | 9/2004 | Wilcocks | 482/124 |
| 2006/0208016 | A1* | 9/2006 | Esch | 224/150 |
| 2007/0207903 | A1* | 9/2007 | Csabai | 482/121 |
| 2008/0190980 | A1* | 8/2008 | Overton | 224/664 |

* cited by examiner

EXERCISE DEVICE AND METHOD

FIELD OF THE INVENTION

This invention relates to the field of physical fitness, and in particular, to the field of exercise devices and methods for physical fitness.

BACKGROUND OF THE INVENTION

Over the past several decades, public awareness of the benefits of exercise has risen. These benefits include better health, lower stress, improved productivity and overall enhanced quality of life.

One result of this increased awareness has been the profusion of commercial health clubs and a growing sophistication and use of "home" or private gyms. These facilities offer consumers the opportunity to achieve higher levels of physical fitness, and claim to have the latest equipment and methods. Overall, the methods and devices are used to address, separately or in combination, the main physiological categories of physical fitness, performance and health. The main categories of physiological adaptation include: cardiovascular (heart, lungs and circulation), strength (muscles and bones), flexibility and neuromuscular coordination. Individually, or in combination, improvements in these categories are usually described, in a general way, as improved "fitness". The available equipment and methods used typically include a wide variety of devices for use in cardiovascular workouts, such as elliptical trainers, exercise bicycles, treadmills and step machines. Other, separate equipment, such as weight machines and free weights, is also provided for workouts intended to increase muscular strength and improved bone health. Still more space, equipment and a variety of methods are commonly made available to allow participants to address the remaining essential components of health and fitness such as flexibility, balance and neuromuscular coordination. Thus, at any particular fitness facility, each piece of equipment, and each corresponding exercise, relates exclusively to a narrow component of overall fitness (e.g. a weight machine that works a single muscle group).

As a result, those using health clubs find themselves having to spend a great deal of time moving from one piece of equipment to another to get a comprehensive workout, or focusing each particular workout session addressing one or a small combination of the main physical fitness categories. The result is that a health club user will either spend a great deal of time at the club to make sure that he works out comprehensively and adequately, or will spend less time at the health club than is optimally necessary and therefore and have inadequate workouts, thereby achieving less than optimal fitness, performance or health-related benefits for their efforts. These time-related inefficiencies associated with health clubs are exacerbated by the fact that using a health club requires the user to be away from home, requiring time for travel to and from the health club. Furthermore, health club equipment is often physiologically non-comprehensive, particularly in the area of muscular strength and neuromuscular coordination. Thus, even spending a lot of time at a health club may not result in an adequate workout.

As a result of the problems associated with using health clubs, some people exercise at home. However, this approach presents its own problems. Most people cannot, because of cost and space constraints, obtain the various pieces of equipment that they (rightly or wrongly) believe are required for a comprehensive workout. Apart from the fact that this lessens the effectiveness of the workouts, there are often fewer options available for particular aspects of the workouts. For example, a person exercising from home may have no option for cardiovascular exercise other than running. However, over-reliance on one particular form of activity can produce over-use injury. For example, over time, running can be very hard on ankles, knees, hips and back, and if the person develops an injury, he may be denied his only cardiovascular exercise option. Similarly, people who wish to achieve muscle strengthening at home typically come up against the challenge represented by the narrow physiological specificity of each piece of equipment (such as a barbell and its particular or isolated muscle group), the limited space available and the financial constraints inherent in accumulating a sufficient amount of strength training equipment to allow the opportunity for a comprehensive muscle strengthening program.

Apart from the risk of over-use injury, the challenge of lack of space in combination with the limited time available, the likelihood of boredom followed by non-compliance because of lack of variety, and the like, such home workouts do not adequately and comprehensively address the main physiological categories of physical fitness, performance and health, namely cardiovascular (heart, lungs and circulation), strength (muscles and bones), flexibility and neuromuscular coordination. For example, a person who exercises at home by jogging and doing nothing else may not obtain adequate workouts in the areas of strength, flexibility and neuromuscular coordination. The individual who adds a few dumbbells or other specific pieces of strengthening equipment, in addition to the treadmill or stationary bicycle, is still in deficit because of the lack of comprehensiveness within the muscular strengthening category as well as the paucity of options for flexibility and neuromuscular coordination. People who wish to exercise anywhere (at a gym, at home, while traveling or in the office), have long sought a solution that meets the challenges presented by fitness comprehensiveness, space, time, variety and cost.

As a result, there have been attempts to create an apparatus to facilitate effective exercise at home. One such apparatus is disclosed in U.S. published application number US 2004/0067827 ("Tustin"). Tustin discloses an exercise device consisting of a simple elastic natural gum rubber band formed in a closed loop. The band may be manufactured in a variety of thicknesses, lengths, and widths to suit the size and muscular strength of the user. The user can use the band for a variety of strengthening exercises, by using various muscles to pull or push the band to a stretched position. The band is elastic, and therefore, offers resistance to being stretched. The relevant muscles are thus worked by stretching the band repetitively.

The Tustin device suffers from a number of defects. First, each individual band has a fixed length and fixed resistance level. Therefore, if the band is too short or too long to be used by a particular user, or if it offers too much or too little resistance for a particular user, it will be necessary for the user to permanently alter the band by shortening it or purchase a new, longer band if lengthening (for larger body size or less resistance) is required. Second, in Tustin, each individual band has a fixed resistance depending on the physical characteristics of the band (such as the material, its width and thickness). Two important elements of appropriate strengthening exercise are: 1) overall tension adjustment (preferably incremental to allow the user to operate within the narrow range between muscle failure and muscle accomplishment, because this where strength adaptation occurs) and 2) specific muscle or muscle group adjustment which takes into account the variable size of muscle groups within the body and the need therefore for a specific tension range suitable for that muscle or group depending on its size and strength characteristics. In the Tustin device, if an individual user wanted more overall resistance or altered resistance for a particular muscle group, he would have to either permanently alter or purchase a new band.

Third, rubber bands tend to have decreased resistance the further they are stretched. In other words, when initially stretched from their un-stretched position, rubber bands have a relatively high tension. As the band stretches out much further, the resistance/tension of the stretched rubber decreases—in a manner that is not linear, making its ability to resist distortion even less, the longer it gets. This works against the principle of muscle overload (which is the physiological/biomechanical basis for strength increase) in that during the time in a contraction when the largest amount of muscle mass is being used (approaching full extension as defined by the length-tension relationship of individual contracting muscle fibers), the resistance offered by the elastic is actually decreasing (as described by the force required to distort it by a specific unit of measurement).

SUMMARY OF THE INVENTION

Therefore, what is desired is an exercise device which permits a user to exercise conveniently and effectively without needing to attend at a health club or have access to complex equipment. Preferably, the device is usable for a wide variety of exercises to improve all of the main physiological categories contributing to improved physical fitness: cardiovascular, strength (muscles and bones), flexibility and neuromuscular coordination. Also, preferably, the device is adjustable so that it can be used effectively by different users, or by an individual user with needs that change over time—the changes that can occur during one particular exercise session (such as requiring more resistance for muscles of larger mass or choosing between an exercise session that focuses on either high resistance and a low number of repetitions or, conversely low resistance and a greater number of repetitions)—or—being able to adjust to a person's strength improvements that occur over the course of time by allowing the same band to be adjusted to offer more resistance during the course of one complete exercise session.

Therefore, according to one aspect of the present invention, there is provided an exercise device comprising a flexible band formed in a closed loop, the device further including at least one tension adjuster associated with the band for selectively adjusting the tension of the loop.

Preferably, the device further includes two handles, associated with the band, the handles being configured to facilitate gripping of the band by a user's hand. Preferably, the handles are configured to be selectively positioned on the band by a user. Preferably, the handles are configured to be slidable along the band. Preferably, the handles are composed of a material having a friction level such that when the handles are gripped against the band by the user's hands, the positions of the handles on the band are effectively fixed while the handles are being gripped. Preferably, each handle comprises a tubular element surrounding the band. Preferably, each handle comprises a resilient material, most preferably foam material. Optionally, the tubular element detachably surrounds the band.

Preferably, the device further includes two foot holders for holding feet of a user. Preferably, each foot holder is configured to surround a foot of the user. Preferably, each foot holder is configured to be tightenable on a user's foot, and to be loosenable to facilitate withdrawal of the user's foot. Preferably, each foot holder includes a top foot strap portion for contacting a top of a user's foot, and a bottom foot strap portion for contacting a bottom of a user's foot. Preferably, each foot holder includes a foot holder actuator to tighten and loosen the foot holder.

Preferably, the band is composed of a flexible material whose tension increases in a linear manner (unlike elastic) as the band is expanded along its length. Preferably, the flexible material is a fabric-rubber weave comprising of rubber threads oriented along the length of the band and substantially inelastic fabric oriented substantially transverse to the length of the band.

Preferably, the band is sized and shaped to permit the band to be held at a user's feet, and gripped by a user's hands, to permit upper body exercise by the user, the upper body exercise including movement of the user's hand. Such movement preferably permits movement of the user's entire arm, shoulder girdle and torso. Preferably, the band is sized and shaped to permit the band to be held at the user's upper body, while the user exercises his lower body by moving a foot against the tension of the band. Such movement preferably permits movement of the user's entire leg, hip and torso.

Preferably, the band is configured to permit the user to hold the band at or near his feet and/or at some other part of the body (e.g. around the user's back) grip the band with his hands, and move his arms and/or torso in a variable resistance exercise in multiple planes or multiple axes. A movement in multiple planes (also "multiplanar" movement) is a movement whose trajectory is not contained within a single plane, but rather, whose trajectory is contained in two or more planes. A movement in or along multiple axes (also "multiaxial" movement) is a movement whose trajectory in not confined to a single axis or line, but rather, whose trajectory is described by or contained within two or more lines or axes. Also, preferably, the band is configured to permit the user to hold the band against a part of his body other than his feet, and moves his feet and/or legs in a variable resistance exercise in multiple planes or multiple axes. "Variable resistance" means that the exercise can be performed at different levels of resistance, preferably by adjusting the tension in the band.

BRIEF DESCRIPTION OF THE DRAWINGS

Reference will now be made, by way of example only, to the drawings, which illustrate the referred embodiment of the invention, and in which.

DETAILED DESCRIPTION OF THE PREFERRED EMBODIMENTS

Figure 1:
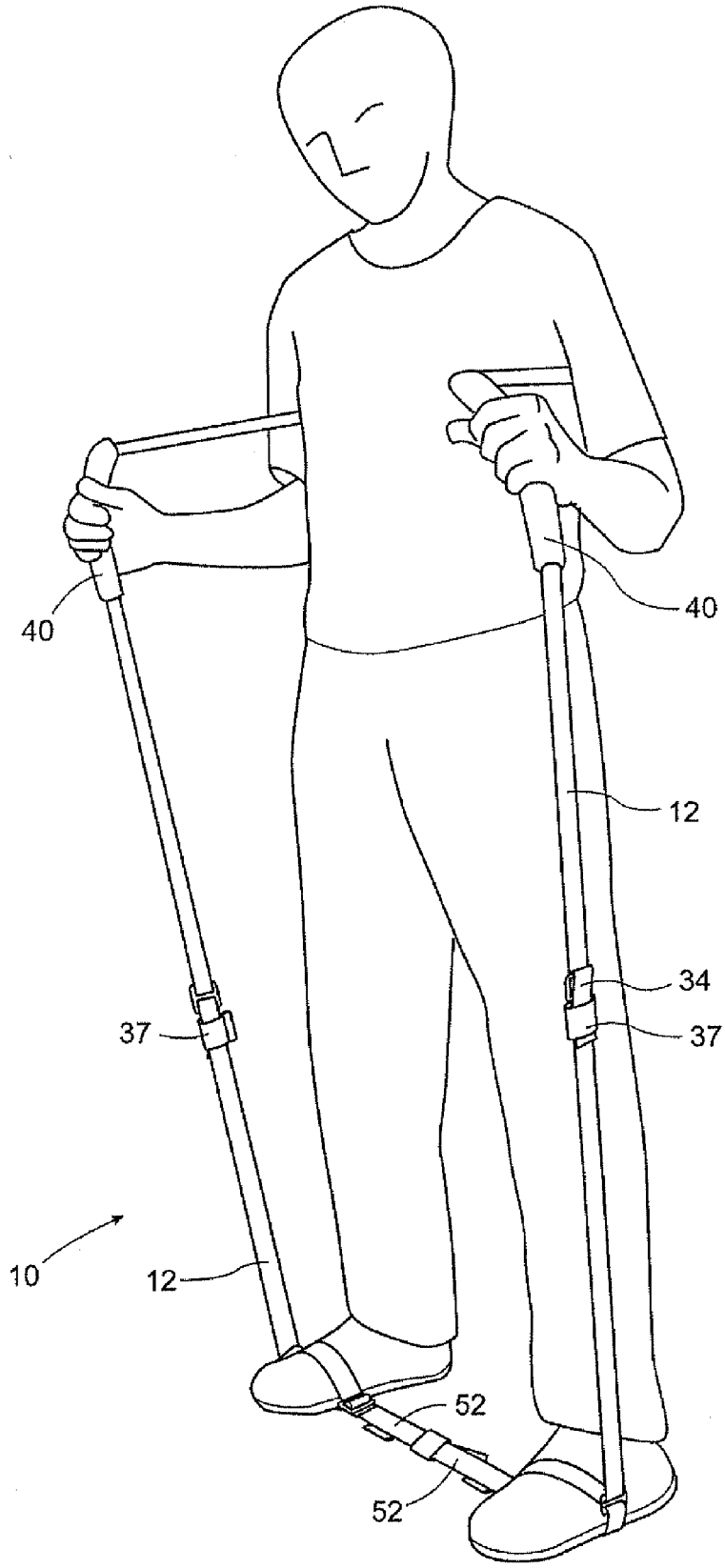
FIG. 1 is a perspective view of an example device in use, with the user's feet inserted into the foot holders and the user's hands gripping the handles.

Referring now to FIG. 1, the device 10 the present invention is shown in use. The device 10 comprises a flexible band 12, formed in a closed loop 11. Thus, when the band 12 is expanded (e.g. by stretching), it provides resistance against the stretching. The band may be held in place by one or more points on the user's body, and expanded against the resistance generated by the band 12. For example, as shown in FIG. 1, the band 12 can be held in place by the user's feet, with the user stepping on the band 12 to hold the band 12 in place at the user's feet. Then, the band 12 can be stretched by the user's arms as shown. When this stretching is done, the band 12 offers resistance to the stretching, thus allowing the user to exercise his arms. In other exercises, the user may exercise a wide variety of muscles against the resistance of the band, including various muscles in the arms, various muscles in the legs, muscles around various joints, and various muscles in associated with the trunk and torso area. Variable positioning and levering of the band against various parts of the user's body allow for a combination of resistance exercises during multiplanar and multiaxial movements by the user. Thus, the band 12 can be used to improve muscle strength as well as joint strength and range of movement (a component of flexibility). If performed in a sequential and systematic manner, such as sequentially engaging muscle groups in the upper limbs followed by the torso and then by the lower limbs, a series of movements using the muscle-group-specific variable resistance of the band can be used to provide a comprehensive (all muscle groups), efficient (at the same time with one device) movement- and muscle-strengthening program.

Preferably, the user will perform the exercises in a prescribed sequence. Using a prescribed sequence of exercises for a number of workouts allows the user's muscles and neuromuscular system to "learn" these movements, thus increasing neuromuscular coordination.

Figure 15:
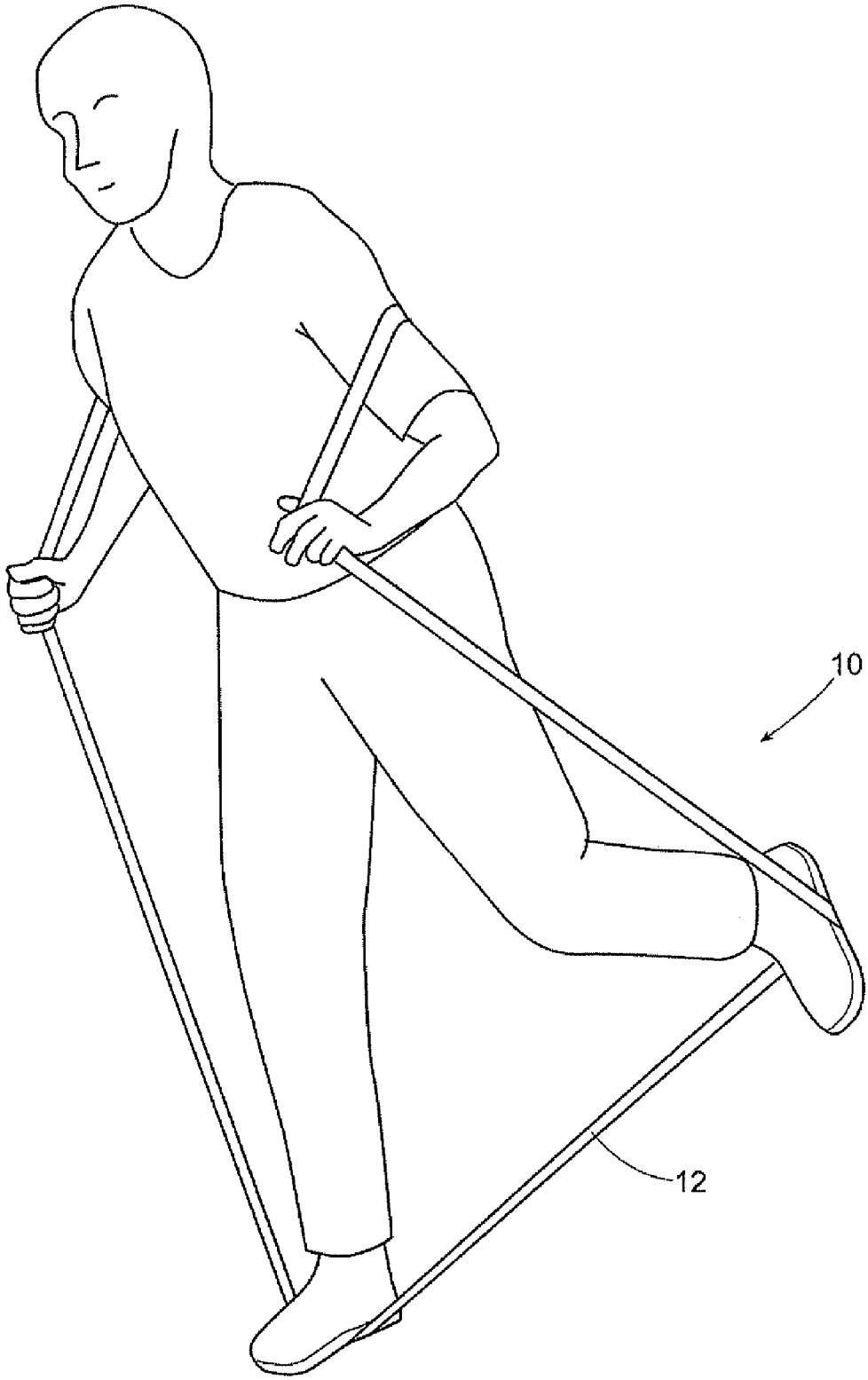
FIG. 15 is perspective view of an example band being used for an exercise requiring the movement of the foot against resistance.

As well, by performing such exercises at a sufficiently rapid pace, and for a long enough time period, the user can get a cardiovascular workout. Also, exercises that improve neuromuscular coordination can also be performed. For example, as shown in FIG. 15, exercises can be performed which require the user to move one or more while balancing on one foot. This balancing during movement of limbs against resistance is one example of exercises that can be performed with the band 12.

Figure 2:
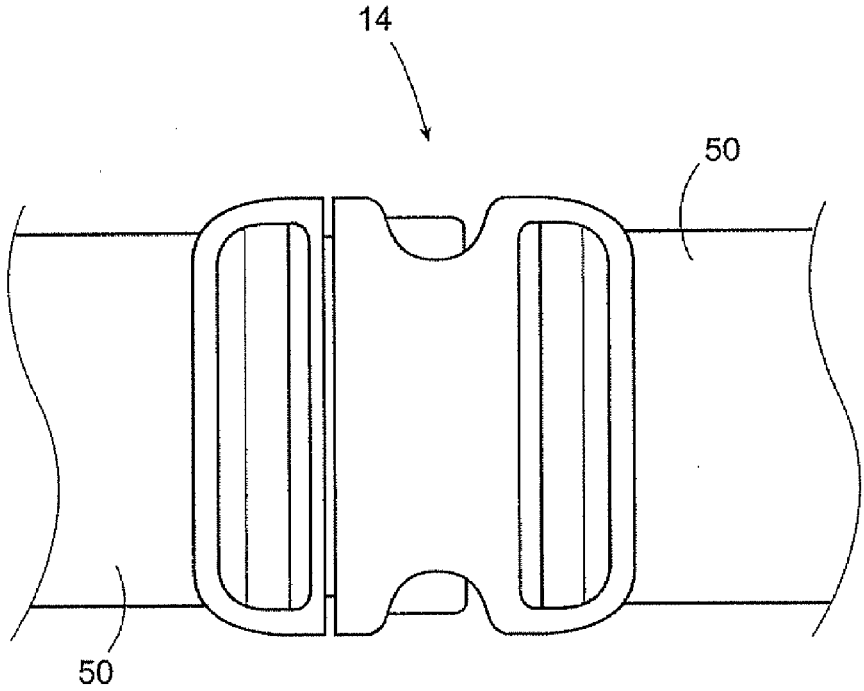
FIG. 2 is a close-up view of the opener in its closed state.
Figure 3:
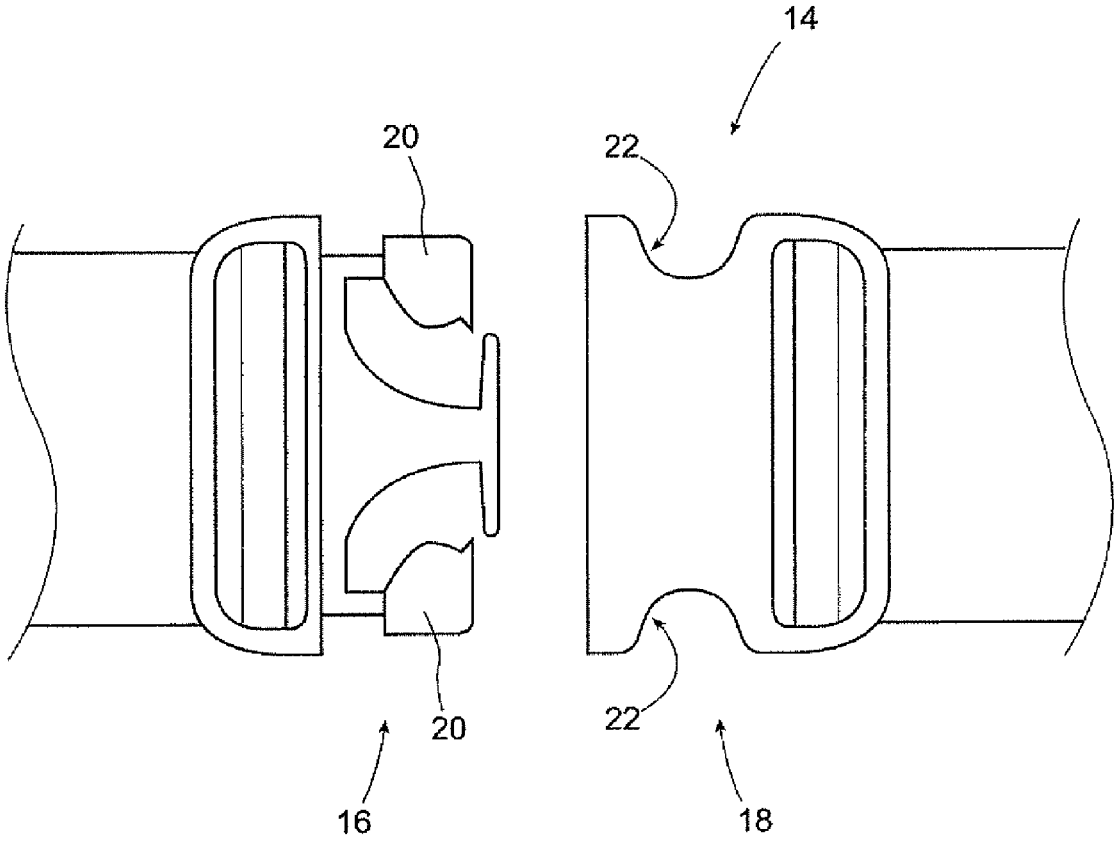
FIG. 3 is a close-up view of the opener in its open state.
Figure 4:
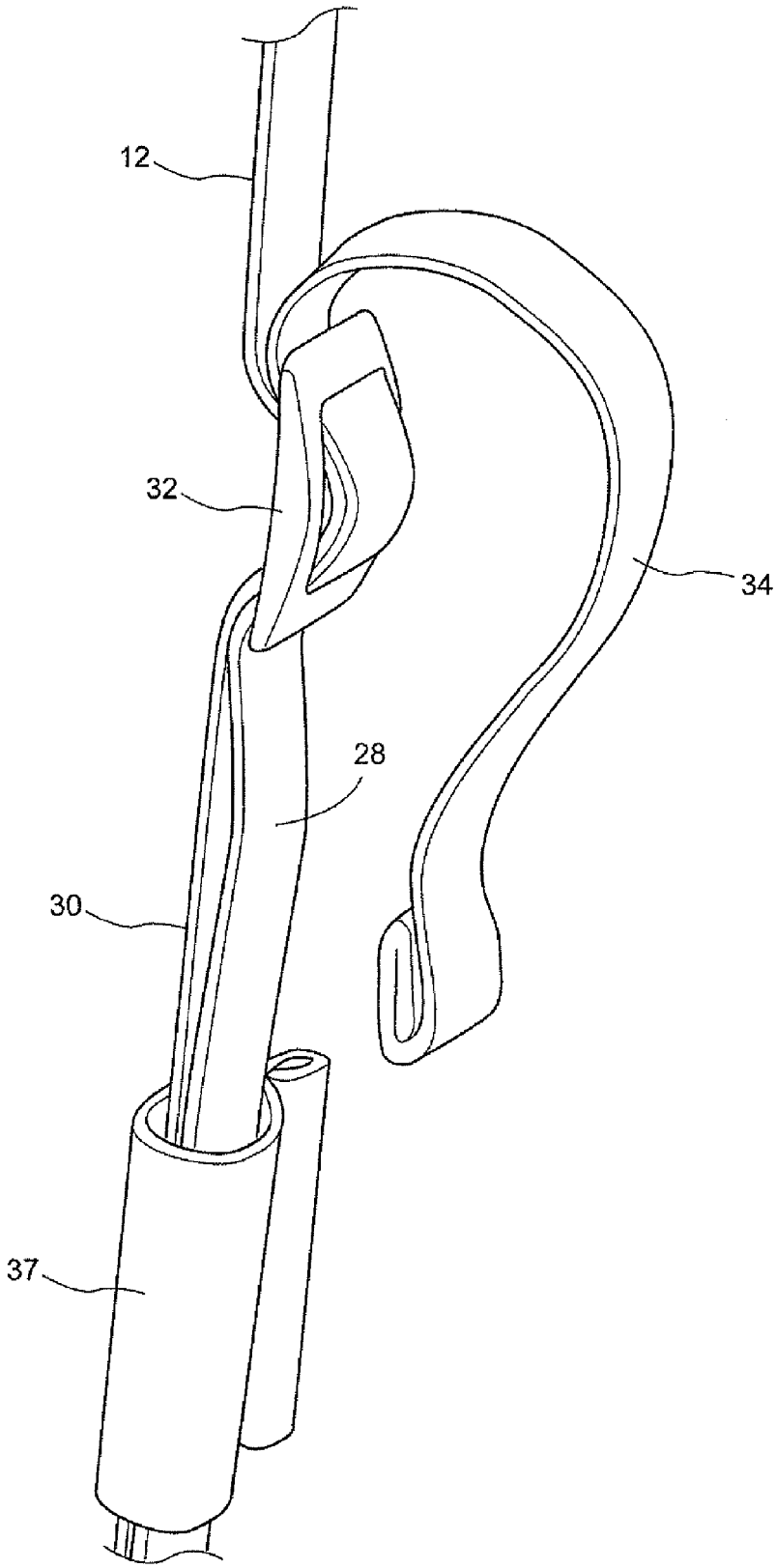
FIG. 4 is a close up view of part of the length adjustable section of an example band.

As shown in detail in FIGS. 2 and 3, preferably, a selective loop opener 14 is mounted to the band 12 to allow the band 12 to be selectively opened. FIG. 2 shows the opener 14 in its closed state, and FIG. 3 shows the opener 14 in its open state. In the embodiment shown in FIGS. 2-3, the opener comprises a male insertion element 16 which is configured to be inserted into a female receiving element 18. The insertion element includes a pair of gripping elements 20 which flex inward as the insertion element 16 is inserted into the receiving element 18. When the insertion of the insertion element 16 into the receiving element 18 is complete, the gripping elements 20 flex outward and grip shoulders 22 in the receiving element 18. The band 12 is thus retained in a closed loop. To open the band 12 using the opener 14, the gripping elements 20 are pressed inward using a user's fingers to release the gripping elements 20 from the shoulders 22. The male and female elements 16 and 18 are then pulled apart to open the band 12. Preferably, the opener 14 is positioned adjacent to (and most preferably between) the foot holders which will be described in more detail below.

As indicated above, it is preferable that the exercise device 10 comprise a flexible band 12 formed in a closed loop that is selectively openable. One advantage of the band being openable is that some of the exercises that can be done with the band 12 require the band 12 to be wrapped around portions of the legs, arms or torso of the user. It is possible that, through error, a user could become entangled in the band 12, thus increasing the risk of tripping, loss of balance and the like. The band's being selectively openable makes use of the band safer and more convenient, because opening the band facilitates disentangling the user from the band 12, thus reducing the risk of tripping, loss of balance and the like. However, it will be appreciated that the invention also comprehends that the band 12 not be selectively openable.

The device 10 preferably includes at least one tension adjuster 24 associated with the band 12 for selectively adjusting the tension of the band 12 formed in a closed loop. By adjusting the tension in the band 12, the amount of resistance offered by the band 12 to the user's movements is adjusted. The greater the tension, the greater the resistance, and the lower the tension, the lower the resistance.

It will be appreciated that different users may require different tension and resistance levels. For example, a user with stronger muscles may require greater resistance in order to provide his muscles with an adequate workout. As another example, someone desiring a more demanding cardiovascular workout may wish to raise the tension and resistance levels of the band 12 in order that his heart and lungs will need to work harder as he exercises. By contrast, a user with weaker muscles, or who desires a less demanding cardiovascular workout, may wish to decrease the tension and resistance in the band 12.

It will also be appreciated that the same user may wish to adjust the tension for different types of workouts, or even during the same workout. For example, a user may wish to perform more intense workouts on Monday, Wednesday and Friday, and less intense workouts on Tuesday and Thursday. As another example, a user may find that certain of his muscles are relatively strong, while others are relatively weak. As such, he may wish to increase the tension for some exercises within the workout, while decreasing the tension for others.

Figure 7:
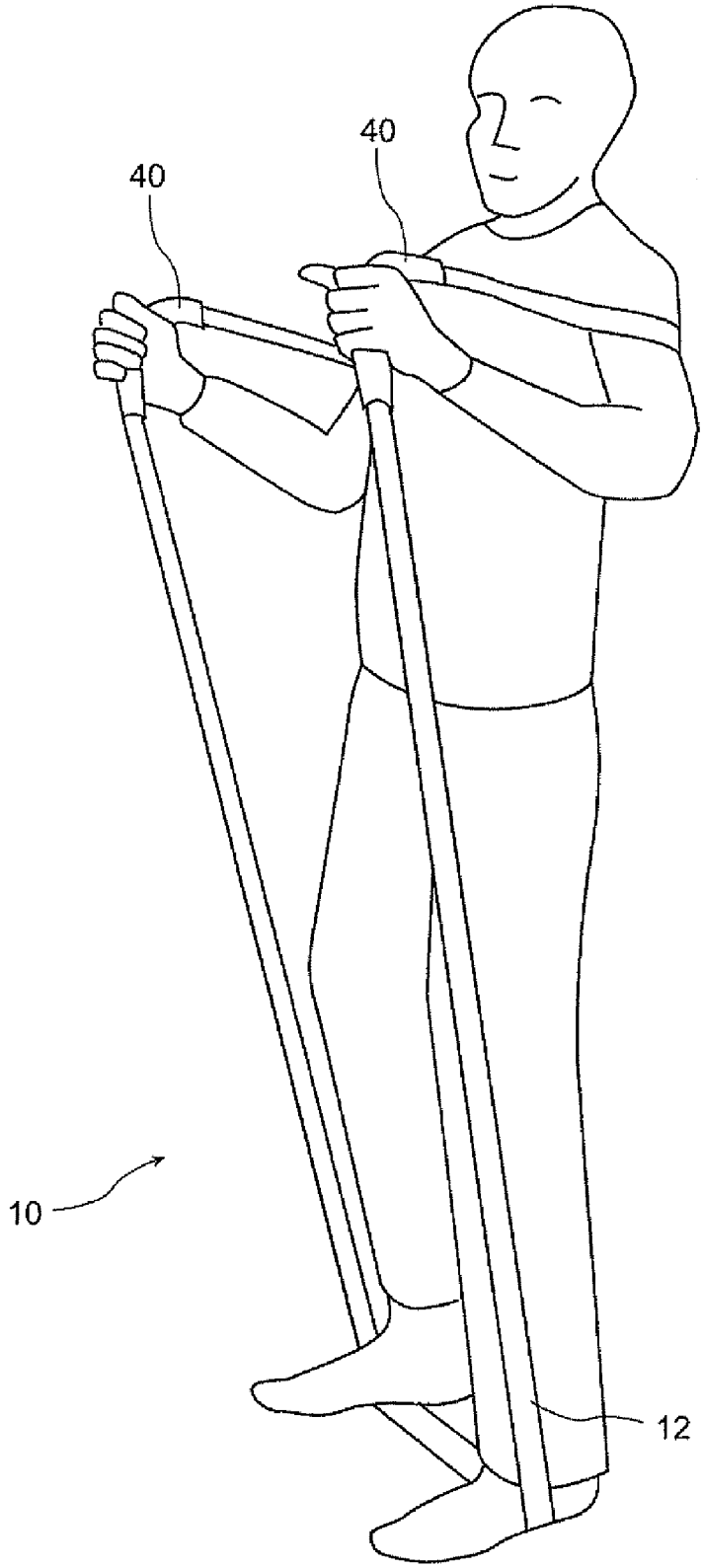
FIG. 7 is a perspective view of an example band in use by a user.

It will be appreciated that the exercise device 10 is preferably used as shown in FIGS. 1 and 7, by holding a portion of the band 12 in place with one part of the body (e.g. the feet or the upper back) and using another part of the body (e.g. the arms) to move the band. For example, the band may be fixed by and/or at the feet of the user, and the handles 40 may be selectively positioned for use. In one type of exercise, the user may stand and raise his hands straight up, and then turn the torso to move the hands in a circle above the head, thus establishing resistance in multiple planes. Alternatively, an exercise may be performed (see FIG. 7) in which a bench-press-type exercise is performed (horizontal plane movement) which the hands are moved together and separated (producing movement in a sagittal (lateral) plane). The result is that the portion of the body used to move the band 12 puts the band 12 in tension when the band 12 is stretched, thus working the muscles that are used to move the band. It will further be appreciated that two layers of flexible material provide greater resistance to stretching of the band (i.e. provide more tension) than a single layer, and that the resistance to stretching increases as the number of layers increases. Put differently, the greater the cross-sectional area of the band, the greater will be the resistance to stretching. Thus, the greater the proportion of the loop 11 that includes two layers of flexible material, as opposed to one, the greater the tension in the loop 11 during exercise. By contrast, the lower the proportion of the band that includes two layers, the lower the tension in the loop 11 during exercise.

Most preferably, the device 10 includes two tension adjusters, though the preferred form of the invention comprehends any number of (i.e. one or more) tension adjusters. The use of two tension adjusters 24 is preferred because it has been found that there is adequate space on the band 12 for two tension adjusters. The use of only one tension adjuster, though adequate, provides a narrower possible range of tensions for the band 12. Furthermore, depending on the position of the tension adjuster 24, the use of a single tension adjuster 24 may result in a tension imbalance, with one side of the band being more resistant to stretching than the other side. This could, in some cases, be preferred. For example, a user may wish to work one arm or leg harder than the other. However, if balanced tension is desired, then it is preferred to have two adjusters 24, or alternatively, to have a single adjustment 24 in a position that distributes tension somewhat evenly on both sides of the loop 11. Meanwhile, the use of more than two tension adjusters has been found to be unwieldy, and there is typically not adequate space on the band 12 for more than two tension adjusters 24 to operate effectively.

It will be appreciate that, preferably, the device accommodates variance in muscle size within the body. Thus, the tension adjusters 24 can be used to attenuate tension (and thus resistance) for smaller muscle groups and increase tension (and thus resistance) for large muscles groups. Also, muscle appropriate tension (and thus resistance) can be created apart from consideration of muscle group size. For example, it may be appropriate to load more heavily a smaller muscle group (or vice versa).

In the alternative, tension in the band 12 can be adjusted by adjusting the length of the band 12 the shorter the band 12, the greater will be the tension in the band for most exercises, because there is less loop length available for stretching; thus, the band material will reach a higher stretch level after relatively little expansion of the band 12, and the band 12 will therefore offer greater resistance to the muscle being exercised. In other words, when the band 12 is shorter, there is greater tension in the band 12 when the user stretches the band 12 in order to exercise particular muscles. Thus, a length adjuster can act as a tension adjuster by selectively adjusting the loop length, thus adjusting the tension in the loop 11. The length adjuster also serves to meet the needs of taller and shorter people. By making the loop smaller, shorter people will have the advantage of a similar range of tensions as would average height people with the standard loop length. The advantage is similar for taller people when the loop is made larger, making one band adaptable for different size users.

Figure 12:
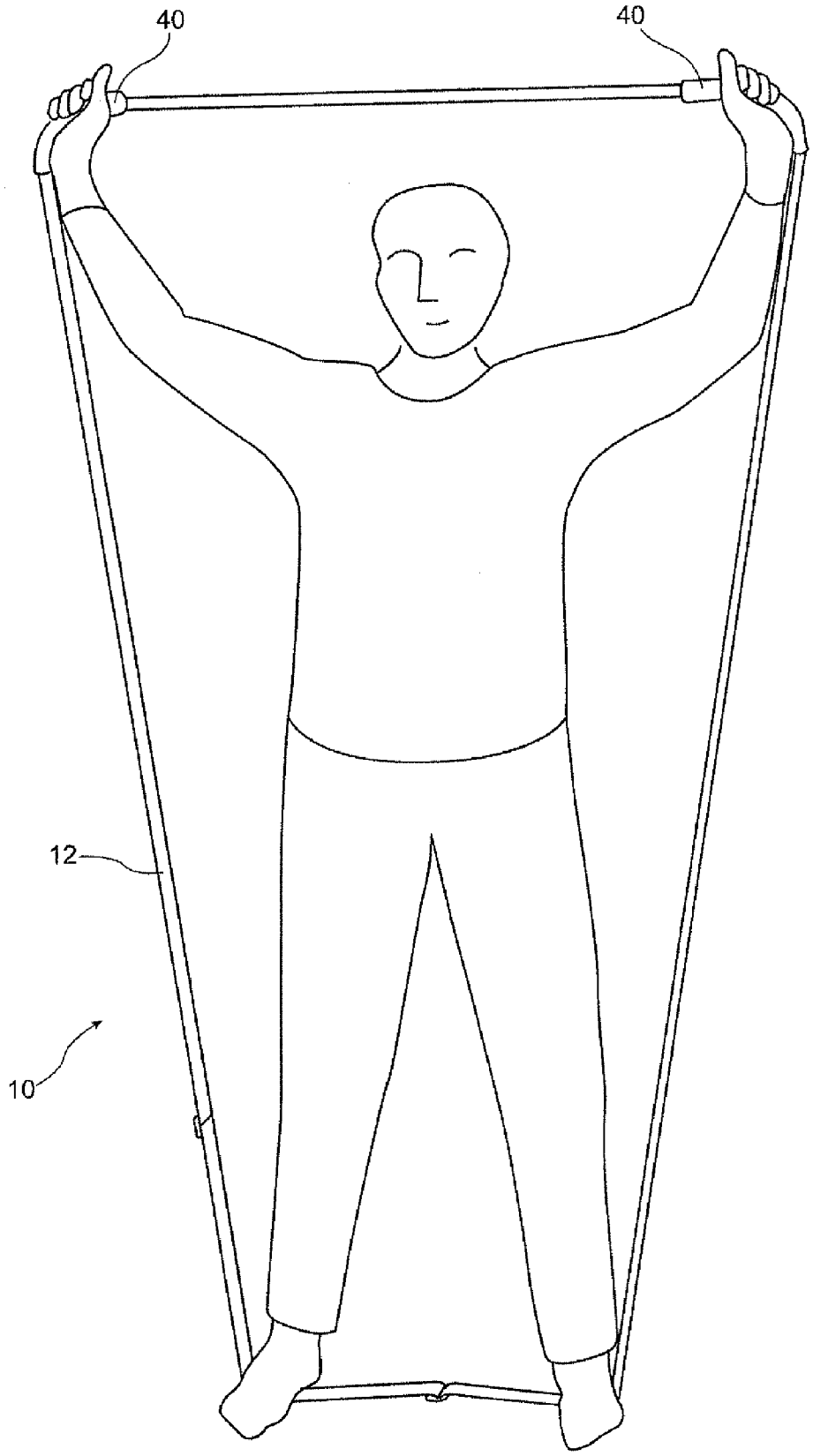
FIG. 12 is a front elevation view of an example band in use by a user.

It will be appreciated that, apart from any increase or decrease in band tension, it is advantageous to have loop length adjusters as part of the device 10. The reason is that the required loop length will vary according to the size of the user. If the user is very tall, broad or long-limbed, a longer band 12 may be required to allow him to effectively perform the desired exercises with the band 12. However, a smaller person (e.g. a child) may require a shorter band 12. For example, FIG. 12 shows a user performing an exercise with his feet holding the band on the floor. The exercise requires, him to hold the band with his hands and raise his arms outward from the sides of his body, and simultaneously upward over his head. A small user performing this exercise would require a relatively short band, because if the band were too long, there would be no tension at all in the band as the user extended his arms up and out. By contrast, a taller user would require a relatively long band 12, because if the band 12 were too short, the user would be unable to fully extend his arms as required by the exercise before reaching the end of the band's stretch capacity.

The preferred form of the tension adjuster 24 is shown in FIGS. 4-6, 8, and 9. The length adjuster 24 comprises a tension adjustable section 26 of the loop in which the band 12 is formed. The section 26 includes an outer loop layer 28 and an inner loop layer 30. The tension adjuster 24 preferably further includes a selectively actuatable adjustable element (most preferably in the form of buckle 32) that is configured to move to expand and contract section 26. When section 26 is expanded, the proportion of loop 11 having two layers rather than one is expanded. When section 26 is contracted, the proportion of loop 11 having two layers rather than one is contracted.

Figure 8A:
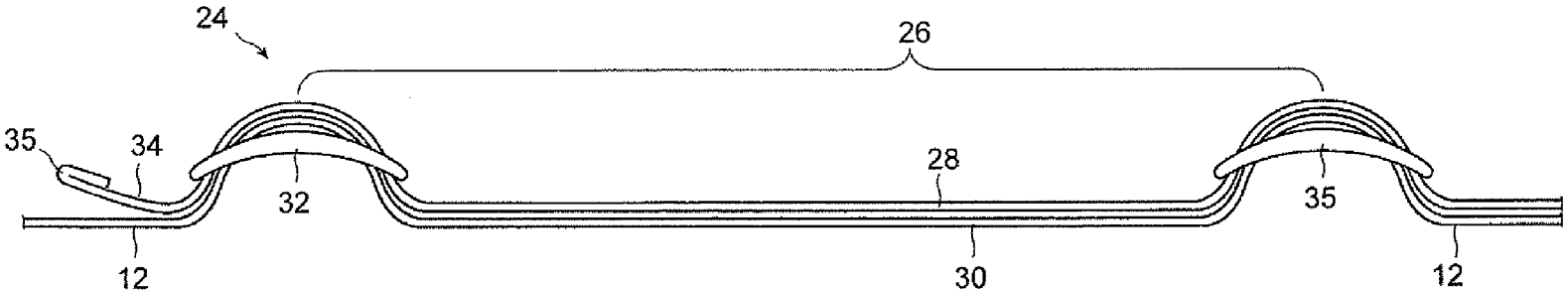
FIGS. 8*a* and 8*b* are a side view of the adjustable section.
Figure 8B:
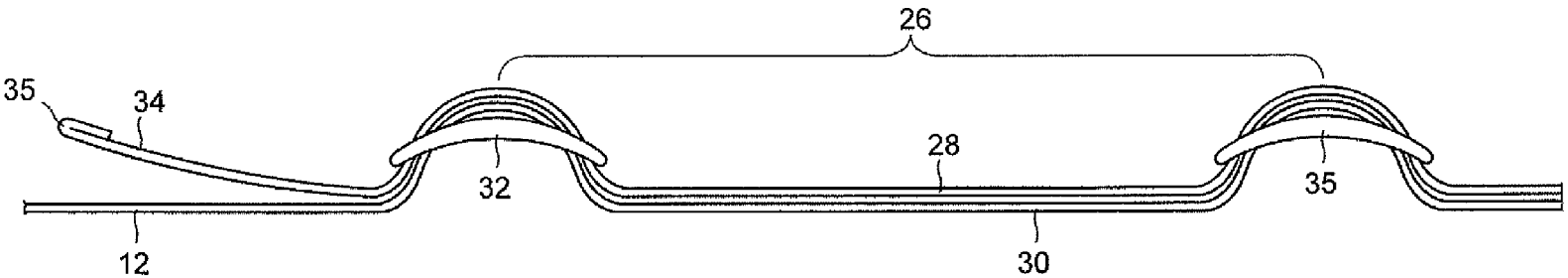
Figure 9:
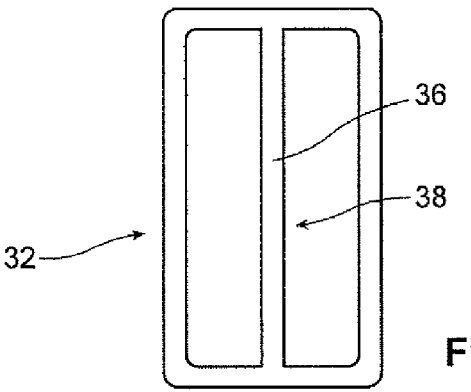
FIG. 9 is a top view of the preferred selectively actuatable adjustment element.
Figure 10:
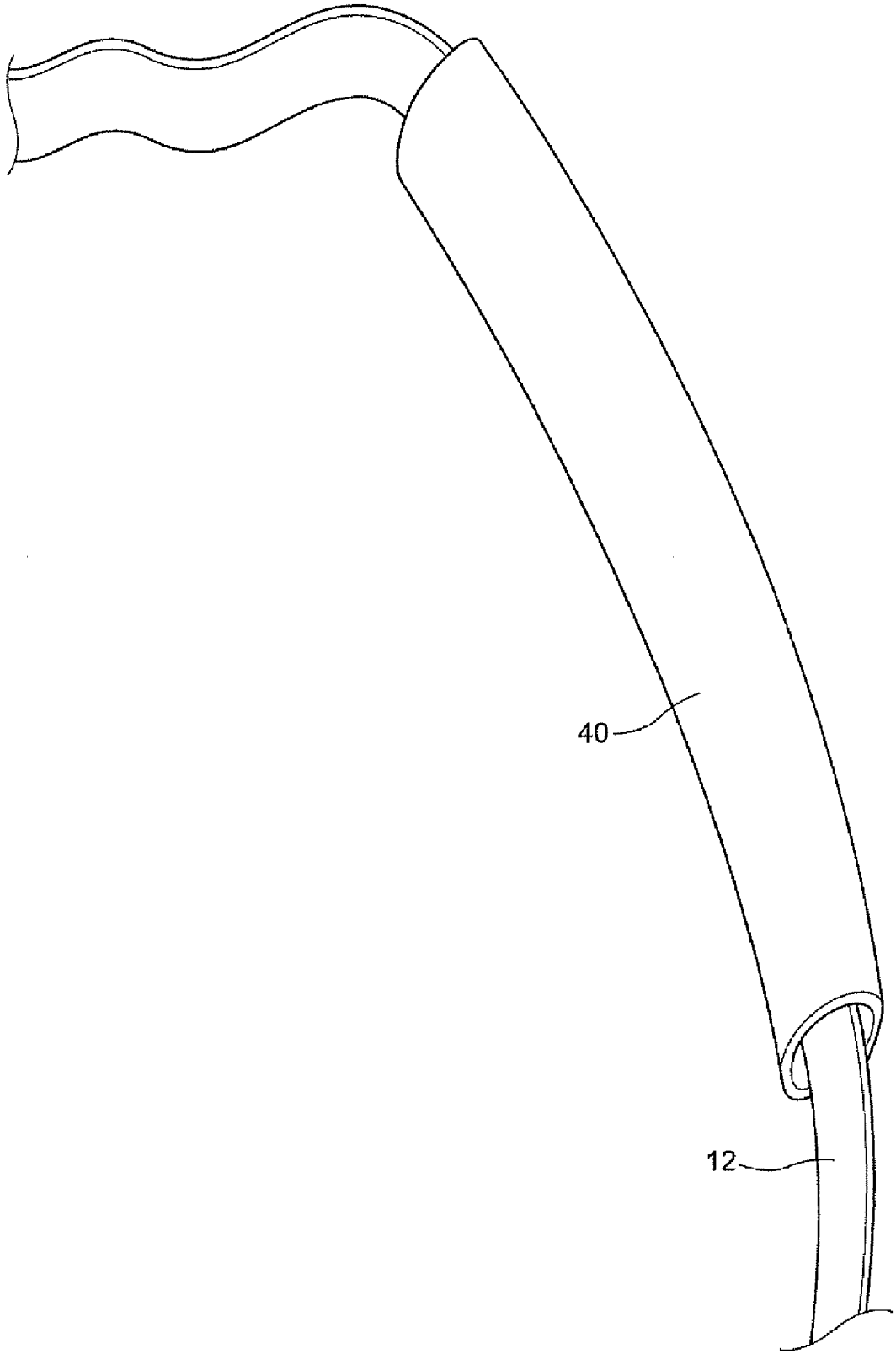
FIG. 10 is a close-up view of a handle.
Figure 11:
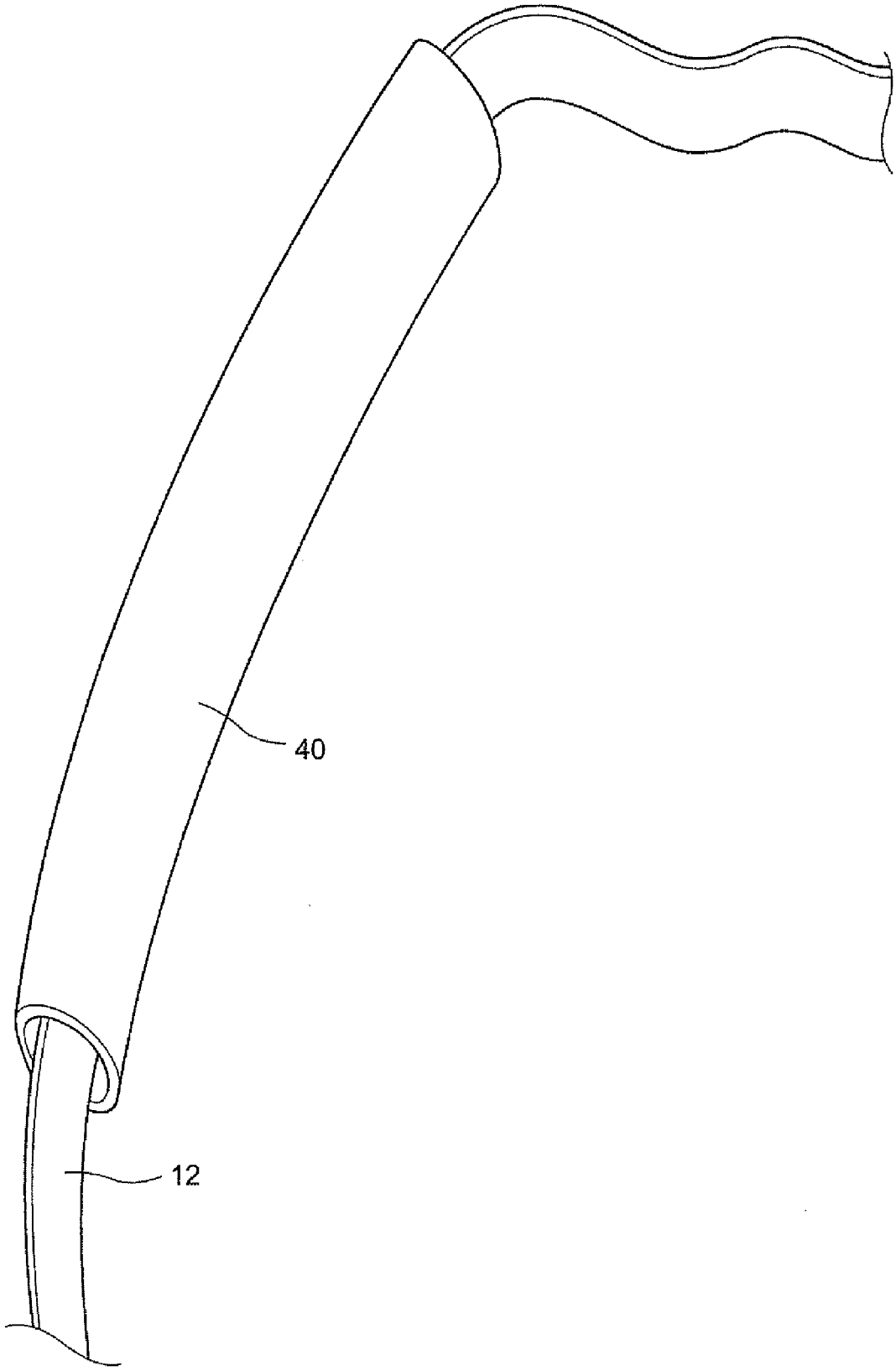
FIG. 11 is a second close-up view of a handle.

Connected to the outer layer 28 via the buckle 32 is a handle portion 34 having end 35. In concert with the buckle 32, the handle portion 34 is used to expand and contract the section 26 as shown in FIGS. 8*a* and *b*. The inner layer 30 is connected via the buckle 32 to the band 12. The outer layer 28 and inner layer 30 are connected to a second buckle 35, from which the band 12 continues. The section 26 is contracted by a user gripping the buckle 32 and the handle 34, and moving the buckle 32 to the right as shown in FIGS. 8*a* and *b*. As this is done, the distance between the brackets 32 and 35 is shortened, thus creating a shorter section 26. Meanwhile, the handle portion 34 gets lengthened. The buckle 32 includes a high friction surface 36 on its central bar 38 to hold the inner layer 30 and band 12 in place relative to the buckle 32 when the user is not lengthening or shortening the loop.

To extend the section 26, the user grips the outer layer 28 and pulls the buckle 32 away from the second buckle 35. As this is done, section 26 expands. Simultaneously, the handle portion 34 gets shortened as the buckle 32 moves away from the second buckle 35.

Preferably, the device 10 further includes one handle holder 37 for each adjuster 24. It will be appreciated that it is advantageous to prevent the handles 34 from hanging loose, because they could get caught on adjacent objects, uncomfortably slap against the user, or otherwise interfere with exercising. The holders 37 preferably comprise loops fastened around the tension-bearing portion 28 and the slack portion 30. Example holders 37 are shown in FIG. 1. In FIG. 1, the handle portions 34 are folded into the holders 37 and held therein so as not to interfere with exercising.

The device 10 preferably includes two handles 40 (see, for example, FIG. 1), each associated with the band 12, and each configured to facilitate gripping of the band 12 by a user's hand. It will be appreciated that, preferably, the handles 40 are configured to be selectively positioned on the band 12 by the user. It is also preferred that the handles 40 be attached to the band 12 (most preferably, un-detachably), so that the handles 40 will not get separated from the band 12 and become lost. Thus, preferably, each handle 40 comprises a tubular element surrounding the band.

It will be appreciated that the exercise device is preferably usable by users of different sizes and shapes. For example, some users may be short, while others tall. Some may be quite broad shouldered and/or have long arms, while others may have short arms and/or narrow bodies. Thus, to permit the handle positions to be adjusted, the handles are preferably configured to be selectively positionable on the band 12 by the user. In this way, the user can position the handles at positions most suited to his body shape and size, and to his desired method of using the band 12. In the preferred embodiment, the handles are slidable along the band 12. To position the handle 40 at a new position, the user can grip the handle 40 at its initial position and move it along the band 12 to its new position.

It will also be appreciated that, once the band 12 is in use and the handles are being gripped, the handles 40 should preferably remain in a fixed position. Once the band 12 is in use, it is important that the user's hand, gripping the handles, not slip along the band, as such slippage can interfere with the user's ability to perform exercises properly. For example, if a user is performing as exercise in which he grips the band 12 at the handles 40, and moves his hands against the band 12's resistance to exercise arm muscles, the user will want the handles 40 not to slip along the band 12. This is because, if such slippage does occur, it may well occur just as the user is contracting a muscle against resistance from the band 12. If this happens, instead of getting resistance, the slippage will "short-circuit" the exercise—instead of the tension in the band 12 causing the user's muscles to work, it may cause the handles 40 to slip. If, however, the handles 40 are configured so as to remain in position when they are gripped, the exercise will not be short-circuited by slippage as described above. The sliding of the handles also allows the user to increase or decrease the resistance of a particular movement by positioning the handles, and therefore his hands, so that the movement works against the desired amount of resistance. The sliding of the handles also allows the user to attain different band positions and geometry is to perform different types of exercises engaging different muscle groups.

Therefore, most preferably, the handles 40 are composed of a material having a friction level such that when the handles are gripped against the band 12 by the user's hands, the positions of the handles 40 on the band 12 are effectively fixed. This ensures that the handles 40 do not unexpectedly slide during use, thus disrupting the exercise routine of the user. Also, the desired level of tension and the appropriate geometry to perform the particular exercise movement are maintained.

For comfort, it is preferred that the handles 40 comprise a resilient material, such as foam. Foam, apart from providing a resilient feel, is inexpensive and makes the device 10 easier to manufacture. Also, it has been found that resilient foam comes in varieties having sufficient friction so that the handles 40 will not slide when being gripped during use. However, such foam has also been found to permit the handles to be repositioned selectively between uses.

As stated above, it is preferred that the handles 40 be tubular elements that are undetachably (i.e. for practical purposes, permanently) attached to the band 12, surrounding the band 12. However, it will be appreciated that the invention comprehends the handles 40 being detachably attachable to the band 12. This could be accomplished, for example, by using Velcro™. For example, the handles 40 could take the form of rectangular pieces of foam, with the hook portion of the Velcro™ positioned along one edge of and on one surface of the rectangle, and the loop portion of the Velcro™ positioned along the opposite edge of and on the opposite surface of the rectangle, to form a Velcro™ closure. The pieces of foam could be attached to the band by simply wrapping them around the band and closing the closure. Other modes of detachable attachment of the handles 40 are also comprehended.

It will also be appreciated that, though handles 40 are preferred, the invention comprehends the device 10 having no handles 40. The user could use the device 10 by directly gripping the band 12, if necessary.

Figure 5:
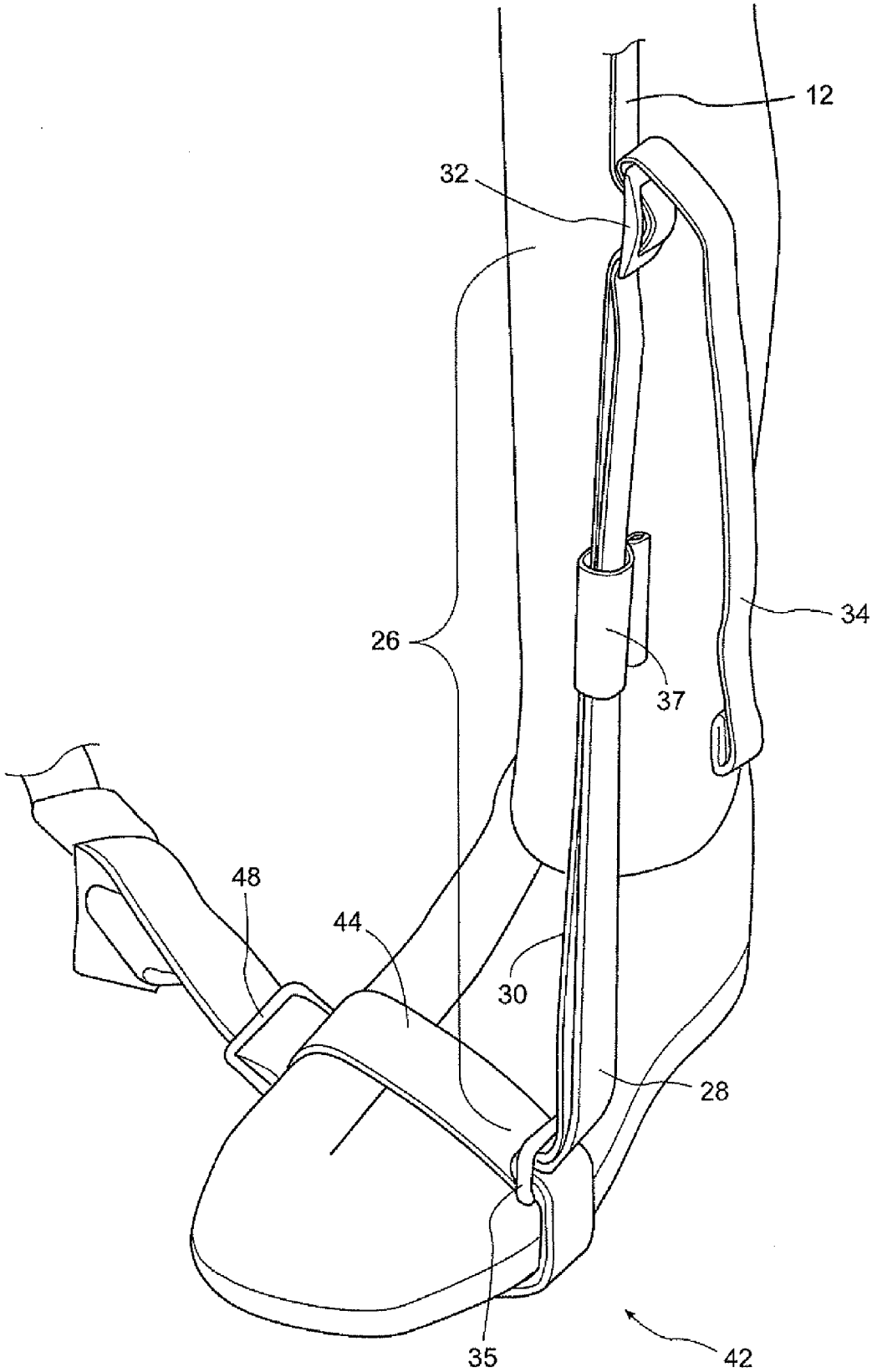
FIG. 5 is a close up view of the length adjustable section of the band, and of a foot holder.
Figure 6:
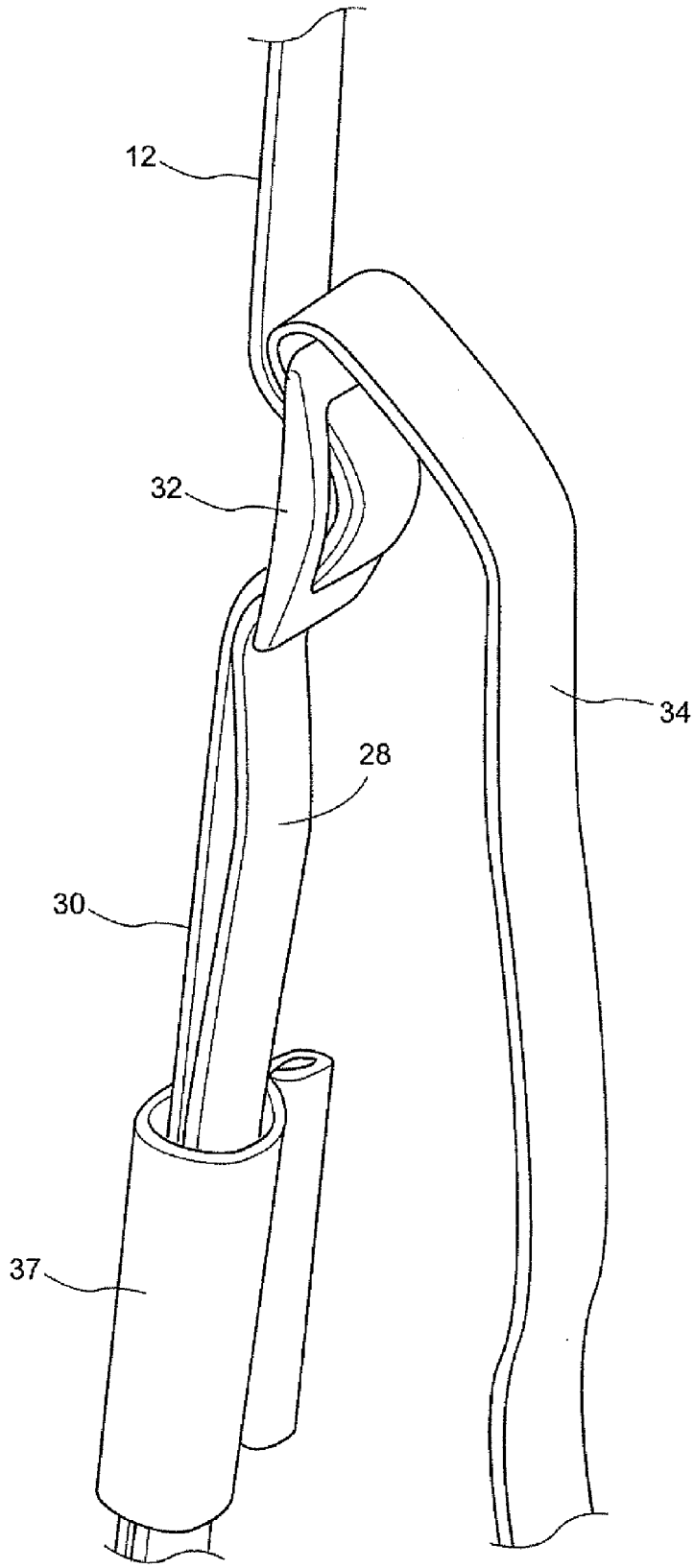
FIG. 6 is a close up view of part of the length adjustable section of an example band.
Figure 13:
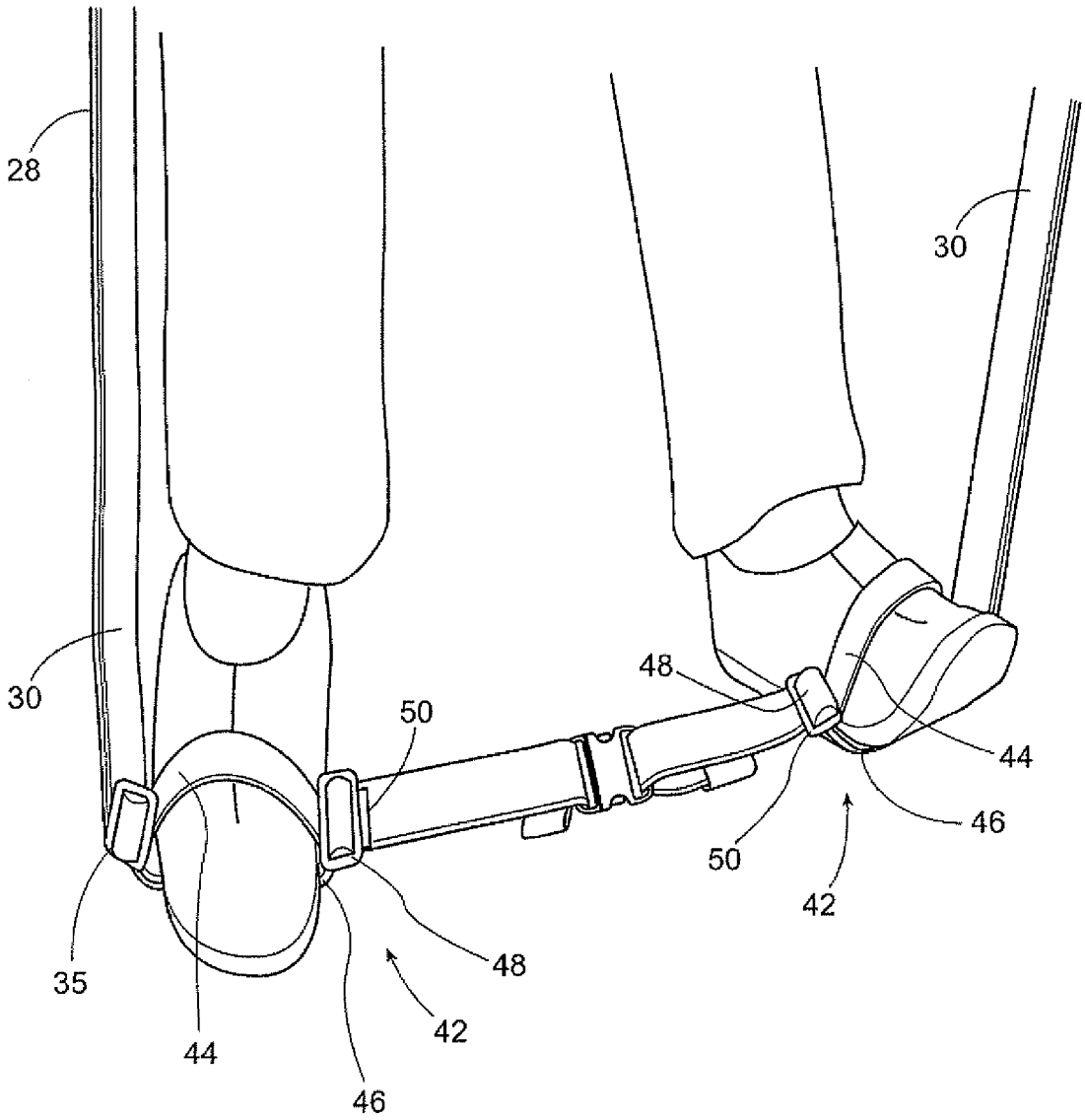
FIG. 13 is a close-up view of two foot-holders and the opener.
Figure 14:
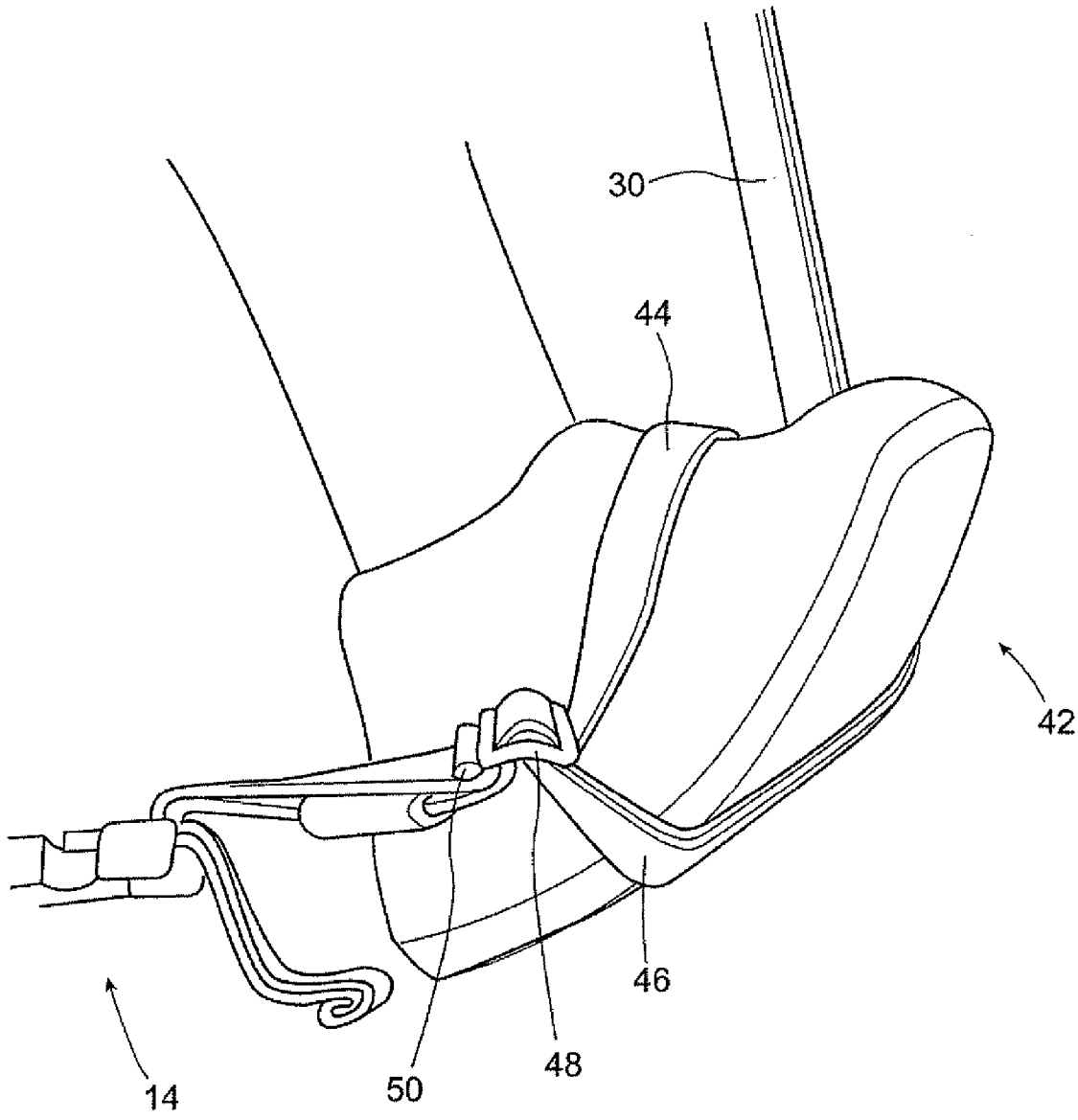
FIG. 14 is a close-up view of a foot-holder.

Preferably, the device 10 includes two foot holders generally designated by reference numeral 42 (see FIGS. 5, 13 and 14). The foot holders 42 are preferably each configured to surround the foot of the user, with each foot holder 42 most preferably comprising a top foot strap portion 44 for contacting the top of the user's foot, and a bottom foot strap portion 46 for contacting a bottom of the user's foot. Optionally, the top portion 44 may itself comprise more than one layer of strap (e.g. two layers). Such a construction will protect against lengthening of the top portion resulting from force applied to it, and ensure that the holder 42 holds the foot of the user more securely. It will be appreciated, however, that in cases where a single layer functions effectively, a single layer is preferred, as using a single layer requires less material and is less complex to manufacture.

The foot holder 42 preferably also includes a foot holder actuator, most preferably in the form of a buckle 48 engaged with the tightening strap 50. The holder 42 is tightenable by holding the buckle 48 and pulling on the strap 50 to tighten the holder 42 around the user's foot. The buckle is connected to the portions 44, 46, so that when the buckle 48 and strap 50 are actuated, the holder 42 is tightened around the user's foot. In the preferred embodiment, portions 44 and 46 are also connected at buckle 35.

Similarly, the holder 42 is loosenable by moving the buckle 48 away from the user's foot, thus increasing the length of the portions 44, 46, and loosening the holder 42 from around the user's foot. Thus, removal of the user's foot from the foot holder 42 is facilitated.

It will be appreciated that this preferred foot holder 42 provides a number of features. First, it will be appreciated that in prior art devices, such as the Tustin reference described above, the exercise device can practically be held in place at the user's feet only by the user stepping on the band. In the preferred embodiment of the device 10, the foot holder 42 surrounds the foot of the user. Thus, the foot holder 42 holds the foot of the user not only from the bottom of the foot, but from the sides and top of the user's foot as well.

The result is that a user can perform a much wider variety of exercises that involve movement of the feet. For example, one exercise that can be done with the device 10 requires the user to hold the band 12 against the ground with one foot, while lifting the other foot and moving it across the vertical midline his body and toward the opposite side of his body. This exercise works the inner thigh muscles. The fact that the foot holder 42 surrounds the foot of the user makes this exercise possible, because as the user's foot is lifted and moved to the side, band 12 continues to hold the user's foot. Therefore, the movement stretches the band 12, and the inner thigh muscle that drives the motion encounters resistance from the band.

This muscle, as well as the hip joint, are thus worked by the exercise. Similarly one can, while standing on one leg, bending the knee at 90°, make a circular motion in the sagittal plane and/or in the vertical plane or positions in between. Muscles on either side of the hip joint responsible for reciprocal movements such as flexion/extension or abduction/adduction can be sequentially engaged during this multiplanar movement in which resistance is offered by the band and facilitated by the foot holder. This is an example of exercise program efficiency offered by the band in that synchronous or reciprocal movements can be undertaken (with resistance, preferably appropriately variable resistance) engaging the entire set of muscle groups around a particular joint—in one set or series of movements—without changing devices or significantly altering body position (such as turning over or around on an exercise bench in order to perform exercises on the other side of the body) or without changing the orientation of the exercise device (machine) or moving to another device entirely. The "multiplanar" resistance movement that is allowed by the device (because of hand grips, foot holders and specific positioning geometries) more closely mimics "real-life" activities and sports, as well as providing opportunity to engage the physiological categories of strengthening and flexibility for the muscles and joints in a particular area, and providing an opportunity to engage sophisticated neuromuscular mechanisms that are also an essential physiologic category of exercise and fitness.

Another example of an exercise whose effectiveness is made possible by the foot-surrounding foot-holder 42 is the following leg and lower-torso exercise. This exercise involves the user standing on one foot. The knee of the other leg is bent and raised toward the opposite hip, thus working the hip flexors and hamstrings. Then, the same leg is swung behind the user and straightened to a position extending horizontally behind the user. This works the quadriceps and lower back muscles. The movements are then repeated in this sequence. Each of these movements stretches the band and encounters resistance, thus working particular muscles, because the foot holders 42 surround the foot, and, therefore, hold the foot of the user if the user moves his foot up, down, sideways or forward. The holder 42 also holds the foot if it moves backward, as long as the foot is tilted to ensure that it is not withdrawn from the holder 42 as it moves backwards.

The band 12 is preferably composed of a flexible material, and most preferably, a material whose tension increases as the material is expanded along the length of the band 12. In other words, as the user pulls the band 12 so that its length is expanded, the tensional force in the band 12 (i.e., the force against which the user must work to expand the band 12) increases. This is to be contrasted with some exercise bands made of rubber or synthetic rubber, whose tensional force decreases as the band's length is expanded beyond a certain point.

Most preferably, the band 12 is composed of a fabric/rubber weave. In this preferred configuration, the rubber threads are oriented along the length of the band 12, while the fabric threads are woven through the rubber threads in a direction substantially transverse to the length of the band 12. The fabric is preferably substantially non-elastic. The result is that the fabric threads act as a brake on the expansion on the rubber threads. As the expansion of the band material begins, the rubber threads stretch and create tension in the band. As the rubber threads expand further, the fabric threads act as a gradual brake on the expansion of the rubber threats, and eventually halt their expansion. Thus, as the band 12 expands, the tension in the band 12 gradually increases until the material reaches its maximum stretch. It will be appreciated that this type of band is preferable because, when exercising, it is best to consistently and constantly have tension resisting the movements of the user. If the band 12 expands without effective limit, as is true with some ordinary rubber exercise bands, then, when the user performs motions for exercise, some portion of these motions may be performed without significant tension or resistance. It will be appreciated that other configurations of the band material are comprehended. Even with such other configurations, what is preferred is that the tension in the band increase as the band 12 stretches, and decrease as the band 12 contracts.

Preferably, the band is configured so that the tension provided by the band, at a particular length, is suitable to the length-tension curve of muscle For a muscle, as the muscle is shortened, the orientation of the contractile elements with in a muscle fiber is maximized. The result is that in order to have appropriate muscle "overload" (the stimulus for strengthening adaptation), the tension that a muscle must overcome should be suitable to its length at a particular moment. In other words, when the muscle is at its most shortened state (such as a bicep curl where a user's hand is almost reaching his shoulder) the orientation of the muscle fibers is such that the muscle's potential to meet resistance or carry a load is actually increased over that which it was when the arm was at another length—90° for example. So, the band 12 preferably does not provide less resistance when the muscle is "stronger". Rubber elastic tubing is prone to do just that, as is weight lifting against gravity (for example bicep curl). In a typical bicep cud, when the biceps are at their best mechanical advantage, the user is actually pulling the weight on a horizontal plane, which offers less resistance than pulling against gravity.

It will also be appreciated that, though not preferred, the invention comprehends the use of ordinary rubber, or other material, in which the tension decreases when the material becomes lengthened. What is important is that the device include a tension adjuster to adjust the tension of the band 12.

It will be appreciated that the band 12 is preferably sized and shaped to permit the band 12 to be held at a user's feet, and gripped by a user's hands to permit upper body exercise by the user, including movement of the user's hands. Such an exercise is shown in FIG. 1. In the example exercise shown in FIG. 1, the band is being held by the user's feet by means of the user standing on the band 12, with his feet inserted into the foot-holders 42. Meanwhile, the user is performing an upper body exercise, consisting of moving his hands outward and upward from his torso.

Meanwhile, the band 12 is also sized and shaped to permit the band 12 to be held at the user's upper body, while the user exercises his lower body, for example, by moving a foot against the tension of the band 12. Such an exercise is shown in FIG. 15, where the user is holding the band 12 at his upper body and exercising his leg by extending his leg behind him against the resistance of the band 12.

It can therefore be appreciated how the preferred structure of the foot holder 42 is beneficial. The top portion 44 grips the foot and exerts tension on the relevant muscles when the leg is moved forward, in front of the users body. Meanwhile, the bottom portion 46 grips the user's foot and exerts tension on the relevant muscles when the leg is moved backward. Also, because the top and bottom portions 44, 46 form a loop, exercises in which the foot is moved sideways can also be performed with resistance, because either the top portion 44, the bottom portion 46, or both, will grip the user's foot and will exert tension thereon.

It will be appreciated that in the preferred form of the band 12 described above, certain sections of the band 12 have two or more layers. For example, the loop length adjusters 24 include two layers, comprising the slack portion 30 and the tension-bearing portion 28. The foot-holders 42 include a top portion 44 and a bottom portion 46. The portion of the band 12 adjacent the opener 14 has an upper layer 50 and lower layer 52 (see FIGS. 1 and 2). The layers 50 and 52 function to connect the opener components 18 and 20 to the band 12. This is accomplished by looping the band 12 through the components 18 and 20, thus forming the two-layer configuration that is reflected by the two layers 50, 52.

Other portions of the band 12, such as those shown in FIG. 1 as being adjacent the handles 40, may have only one-layer.

It will be appreciated that when the band 12 is stretched, and tension is created in the band 12, the parts of the band 12 comprised of two layers will stretch less than the portions of the band 12 comprised of one layer. In other words, the one-layer parts of the band 12 offer less resistance to stretching than the two-layer portions, thus resulting in greater stretching of the one-layer portions than of the two layer portions. To some extent, this may be useful, since, as shown in the figures, the two-layer portions of the band can be concentrated toward the lower body of the user, where larger muscle groups, requiring greater resistance, are located.

Nevertheless, this imbalance in stretching and resistance between different portions of the band 12, if too large, can result in exercise movements meeting less resistance than may be desirable. Specifically, in response to certain exercise movements, the single-layer portion may stretch greatly while the double-layer portion stretches only slightly, thus causing the band to offer too little overall resistance to the movement. In addition, some exercise will specifically involve the stretching of the single layer portion of the band. For these exercises, less resistance may be offered by the band 12 than may be desired.

Therefore, preferably, the device 10 includes a resistance equalizer associated with the band 12 to equalize resistance around the band 12. Most preferably, the resistance equalizer results in substantially full equalization of resistance around the band 12. Less preferably, the resistance equalizer reduces the inequality of resistance around the band 12.

Figure 16:
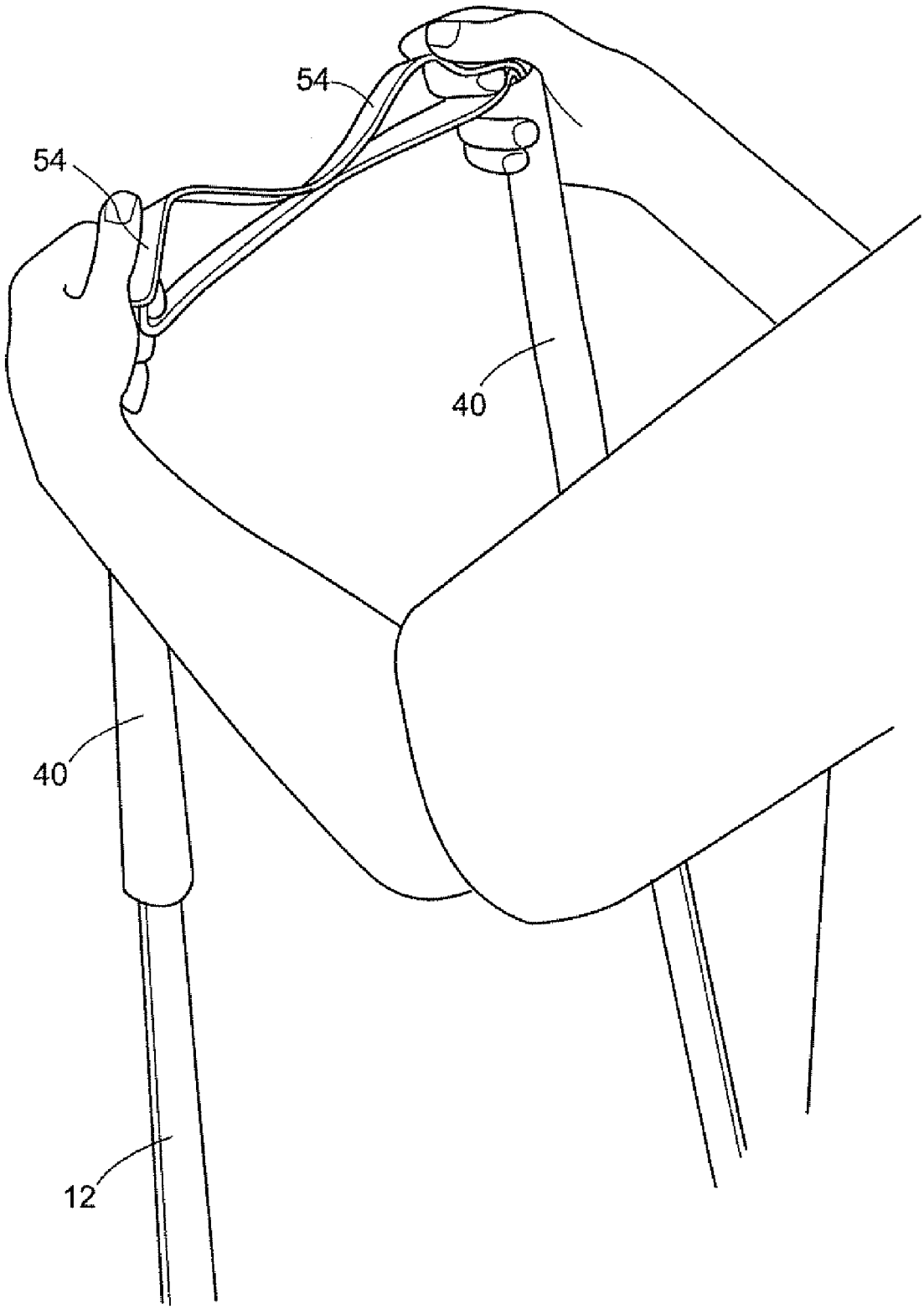
FIG. 16 is a close-up view of the resistance equalization layer.

Preferably, the resistance equalizer takes the form of one or more resistance equalization layers 54 (see FIG. 16) attached to the band 12. The resistance equalization layer 54 comprises an additional layer added to the band 12 to increase the resistance to stretching of that part of the band 12. When attached to a portion of the band that comprises a single layer, the layer 54 has the effect of increasing the resistance of that portion of the band 12, thus decreasing the inequality of resistance between single- and double-layered portions of the band. It will be appreciated that the band 12 may include one or more resistance equalization layers 54 to create the desired distribution of resistance in the band.

It will be appreciated that other forms of resistance equalizer are comprehended. What is important is that the resistance equalizer (if present in the device 10) have the effect of decreasing inequality in resistance between different portions of the band 12.

While reference has been made to various preferred embodiments of the invention other variations are comprehended by the broad scope of the appended claims. Some of these have been discussed in detail in this specification and others will be apparent to those skilled in the art.

The invention claimed is:

1. An exercise device comprising:

a flexible band formed in a closed loop, a section of the loop having a plurality of band layers in use and in tension, each of the band layers overlapping each other, the section of the loop having a first end and a second end, a remainder of the loop extending from the first end, away from the section of the loop, and being connected to the second end, to form the closed loop; and at least one tension adjuster associated with the band for selectively adjusting the tension of the loop, the at least one tension adjuster comprising a first selectively actuatable adjustable element positioned on the flexible band and configured to move along the flexible band, the section of the loop having the plurality of band layers extending between the first selectively actuatable adjustable element and a second selectively actuatable adjustable element positioned on the flexible band, the at least one tension adjuster being configured to increase tension by moving the first selectively actuatable adjustable element to increase a length of the section of the loop having the plurality of band layers, and to decrease tension by moving the first selectively actuatable adjustable element to decrease the length of the section of the loop having the plurality of band layers, wherein the first selectively actuatable adjustable element is configured to expand and contract the proportion of the closed loop having the plurality of band layers relative to the remainder of the loop.

2. An exercise device as claimed in claim 1, wherein the device further includes two handles, associated with the band, the handles being configured to facilitate gripping of the band by a user's hand.

3. An exercise device as claimed in claim 2, wherein the handles are configured to be selectively positioned on the band by a user.

4. An exercise device as claimed in claim 3, wherein the handles are configured to be slidable along the band.

5. An exercise device as claimed in claim 4, wherein the handles are composed of a material having a friction level such that when the handles are gripped against the band by the user's hands, the positions of the handles on the band are effectively fixed while the handles are being gripped.

6. An exercise device as claimed in claim 2, wherein each handle comprises a tubular element surrounding the band.

7. An exercise device as claimed in claim 6, wherein each handle comprises a resilient material.

8. An exercise device as claimed in claim 7, wherein each handle comprises foam material.

9. An exercise device as claimed in claim 6, wherein the tubular element detachably surrounds the band.

10. An exercise device as claimed in claim 1, wherein the device further includes two foot holders for holding feet of a user.

11. An exercise device as claimed in claim 10, wherein each foot holder is configured to surround a foot of the user.

12. An exercise device as claimed in claim 11, wherein each foot holder is configured to be tightenable on a user's foot, and to be loosenable to facilitate withdrawal of the user's foot.

13. An exercise device as claimed in claim 12, wherein each foot holder includes a top foot strap portion for contacting a top of a user's foot, and a bottom foot strap portion for contacting a bottom of a user's foot.

14. An exercise device as claimed in claim 12, wherein each foot holder includes a foot holder actuator to tighten and loosen the foot holder.

15. An exercise device as claimed in claim 1, wherein the band is composed of a flexible material whose tension increases as the band is expanded along its length.

16. An exercise band as claimed in claim 15, wherein the flexible material is a fabric-rubber weave comprising of rubber threads oriented along the length of the band and substantially inelastic fabric oriented substantially transverse to the length of the band.

17. An exercise device as claimed in claim 1, wherein the band is sized and shaped to permit the band to be held at a user's feet, and gripped by a user's hands, to permit upper body exercise by the user, the upper body exercise including movement of the user's hand.

18. An exercise device as claimed in claim 1, wherein the band is sized and shaped to permit the band to be held at the user's upper body, while the user exercises his lower body by moving a foot against the tension of the band.

19. An exercise device as claimed in claim 1, further including at least one loop length adjuster associated with the band for selectively adjusting the length of the loop.

20. An exercise device as claimed in claim 1, wherein said tension adjuster is configured to selectively adjust the tension of the loop without changing the length of the loop.

* * * * *